US007174690B2

(12) United States Patent
Zadeh

(10) Patent No.: US 7,174,690 B2
(45) **Date of Patent: *Feb. 13, 2007**

(54) VERTICAL SLIDE CLIP

(75) Inventor: Rahim Allagheband Zadeh, McDonough, GA (US)

(73) Assignee: Dietrich Industries, Inc., Pittsburgh, PA (US)

( * ) Notice: Subject to any disclaimer, the term of this patent is extended or adjusted under 35 U.S.C. 154(b) by 44 days.

This patent is subject to a terminal disclaimer.

(21) Appl. No.: 10/732,753

(22) Filed: Dec. 10, 2003

(65) Prior Publication Data

US 2004/0118075 A1 Jun. 24, 2004

Related U.S. Application Data

(63) Continuation of application No. 09/912,098, filed on Jul. 24, 2001, now Pat. No. 6,688,069.

(60) Provisional application No. 60/220,420, filed on Jul. 24, 2000.

(51) Int. Cl.
*E04B 1/38* (2006.01)
*E04C 5/00* (2006.01)

(52) U.S. Cl. ..... 52/715; 52/712

(58) Field of Classification Search ..... 52/715, 52/712, 702, 655.1, 656.9, 243.1, 235, 165, 52/714; 248/300, 903, 542, 298.1, 295.11; 403/403, 231; 411/546
See application file for complete search history.

(56) References Cited

U.S. PATENT DOCUMENTS 1,486,509 A 3/1924 Whittaker
1,600,794 A 9/1926 Brown
4,060,905 A 12/1977 Light
4,261,593 A * 4/1981 Yeager ..... 280/415.1
4,433,524 A 2/1984 Matson
4,691,491 A * 9/1987 Lilley ..... 52/22
4,723,747 A 2/1988 Karp et al.
4,918,893 A * 4/1990 Vandenbroucke et al. . 52/404.2
4,920,713 A * 5/1990 Borresen et al. ..... 52/200

(Continued)

OTHER PUBLICATIONS

The Steel Network, Curtain Wall Brochure, date unknown, Raleigh, North Carolina.

(Continued)

*Primary Examiner*—Anita M. King
(74) *Attorney, Agent, or Firm*—Kirkpatrick & Lockhart Preston Gates Ellis LLP

(57) ABSTRACT

Brackets for interconnecting building components. One bracket embodiment is constructed to connect a pair of substantially perpendicular building components so as to allow relative vertical movement between those components and may include a first connector plate and a second connector plate. The first and second connector plates may be integrally connected at a right angle so as to form a right angled juncture. A plurality of stiffener channels may be disposed in the right angle juncture. The bracket may further include a plurality of substantially linear stiffener channels formed in the first connector plate. One or more elongated slots may be provided in the second connector plate. In another embodiment, one or more rows of holes are provided in the connector plate. The elongated slots or rows of holes may be located in one or more recessed stiffener regions. A score line and/or dimples may be provided in the first connector plate for locating fasteners.

34 Claims, 4 Drawing Sheets

U.S. PATENT DOCUMENTS 4,932,173 A * 6/1990 Commins ..... 52/92.2
5,313,752 A 5/1994 Hatzinikolas
5,398,902 A * 3/1995 Crowe ..... 248/300
5,454,203 A * 10/1995 Turner ..... 52/720.1
5,467,566 A 11/1995 Swartz et al.
5,555,694 A * 9/1996 Commins ..... 52/702
5,587,555 A * 12/1996 Rinderer ..... 174/49
5,640,823 A 6/1997 Bergeron et al.
5,664,392 A 9/1997 Mucha
5,670,076 A * 9/1997 Leek ..... 249/53 M
5,720,571 A 2/1998 Frobosilo
5,732,519 A * 3/1998 Leek ..... 52/293.3
5,846,018 A * 12/1998 Frobosilo et al. ..... 403/403
5,857,306 A 1/1999 Pellock
5,885,024 A * 3/1999 Zupan et al. ..... 403/389
5,904,023 A * 5/1999 diGirolamo et al. ..... 52/712
5,906,080 A * 5/1999 diGirolamo et al. ..... 52/243.1
6,009,681 A 1/2000 Kozloff
6,018,923 A 2/2000 Wendt
6,088,982 A 7/2000 Hiesberger
6,213,679 B1 4/2001 Frobosilo et al.
6,688,069 B2 * 2/2004 Zadeh ..... 52/715
6,796,099 B1 * 9/2004 Georges et al. ..... 52/699
7,065,932 B2 * 6/2006 Roesset et al. ..... 52/712
2002/0062617 A1 5/2002 diGirolamo

OTHER PUBLICATIONS

Super Stud Building Products, Inc., Curtain Wall Deflections Solutions Brochure, 2001, Astoria, New York.

* cited by examiner

VERTICAL SLIDE CLIP

CROSS REFERENCE TO RELATED APPLICATIONS

This application is a continuation application of U.S. patent application Ser. No. 09/912,098 to Rahim Allagheband Zadeh, filed Jul. 24, 2001 now U.S. Pat. No. 6,688,069 and entitled Vertical Slide Clip and which claims the benefit of U.S. Provisional Patent Application Ser. No. 60/220,420, filed Jul. 24, 2000.

TECHNICAL FIELD

This invention relates to steel stud building systems, and, more particularly to brackets for connecting vertical steel wall studs to a building structure in a manner to permit relative vertical movement but prevent relative horizontal movement therebetween.

BACKGROUND OF THE INVENTION

Many industrial and commercial buildings and an increasing number of residential buildings are being constructed with steel stud wall systems for the various benefits obtained, such as reduced environmental concerns, fire safety and reduced susceptibility from warpage, insects, rust and rot.

In the construction of buildings that may be subject to deflection due to wind or seismic forces, it is preferable to allow a degree of freedom of movement to reduce stress and to prevent fracture of connected parts. Ceilings often must rest directly on a structural frame or on load-bearing walls. Curtain walls, meaning walls such as partition walls which are not intended to support vertical loads, are best designed to not support vertical loads due to deflection of the primary load-bearing support structure of the building. Deflection is due to changes in the live loads.

In addition to the occurrence of wind induced or seismic stress loading of a building structure, building component deflection is caused by changes in live or dead loading of the floor below or the ceiling above the curtain wall. However, typical prior construction systems have been designed so that all parts of a building are connected in a rigid and permanent fashion. When such a building structure is stressed, curtain walls tend to be damaged and the degree of damage sustained by other building parts is also increased.

SUMMARY OF THE INVENTION

It is therefore an object of this invention to provide an apparatus for connecting a curtain wall to the primary structure so as to allow relative vertical movement therebetween while restricting relative horizontal movement.

Additional objects, advantages and other novel features of the invention will be set forth in part in the description that follows and in part will become apparent to those skilled in the art upon examination of the following or may be learned with the practice of the invention as described and claimed herein.

To achieve the foregoing and other objects, and in accordance with one aspect of the present invention, an improved bracket for connecting a pair of substantially perpendicular building components is provided. The bracket of the present invention advantageously allows relative vertical movement between the perpendicular building components. Preferably, the bracket includes a first connector plate joined at an edge and aligned with a second connector plate in substantially a right angle to form a right-angled juncture.

A number of substantially triangular stiffener channels are disposed in the right-angled juncture each having a substantially U-shaped cross section. Additionally, a number of substantially linear stiffener channels are provided in the first connector plate that preferably each extend from a corresponding triangular stiffener channel.

The second plate includes a number of elongated slots through which the plate may be connected with a shoulder crew or the like to a building component. The slot allows for vertical movement of the building structure without transferring compressive loads to the building component connected to the second plate, such as an exterior curtain wall. The first plate may be connected to structural framing of the building. When the structural framing of the building flexes downward, the bracket of the present invention allows for relative vertical movement thus relieving stresses and eliminating and resisting horizontal forces caused by wind or seismic loads.

Still other objects of the present invention will become apparent to those skilled in this art from the following description and drawings wherein there is described and shown preferred embodiments of the invention. As will be realized, the invention is capable of other different embodiments, and its several details are capable of modification in various, obvious aspects all without departing from the invention. Accordingly, the drawings and descriptions will be regarded as illustrative in nature and not as restrictive.

DESCRIPTION OF THE DRAWINGS

The accompanying drawings incorporated in and forming a part of the specification illustrate several aspects of the present invention, and together with the description and claims serve to explain the principles of the invention. In the accompanying drawings:

DETAILED DESCRIPTION OF THE INVENTION

Reference will not be made in detail to the present preferred embodiments of the invention, examples of which are illustrated in the accompanying drawings wherein like numerals indicate corresponding elements throughout the figures.

Figure 1A:
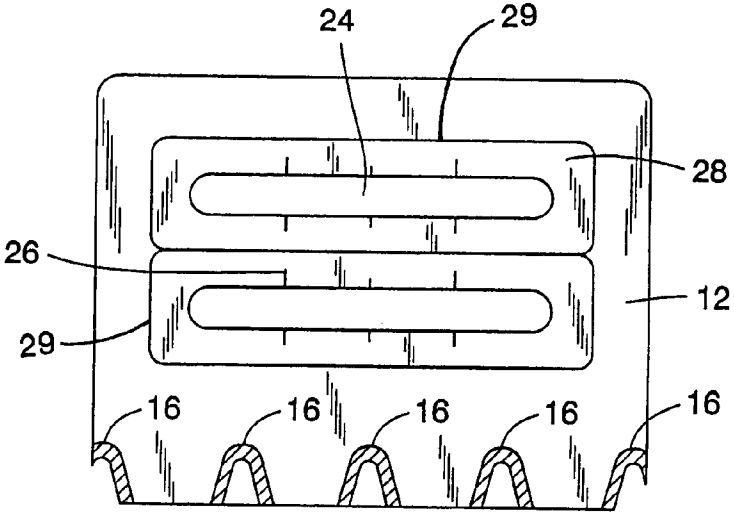
FIG. 1A is a cross-sectional view of the bracket of FIG. 1 taken along plane 19 in FIG. 1.
Figure 1B:
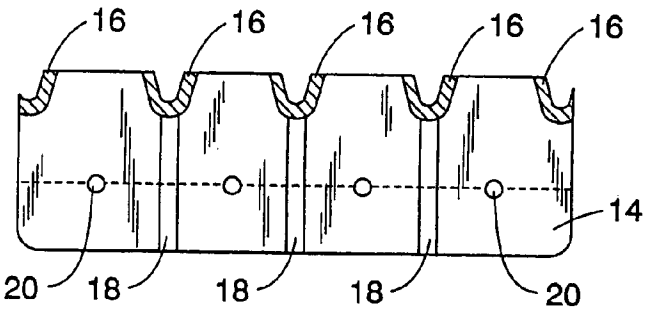
FIG. 1B is a cross-sectional view of the bracket of FIG. 1 taken along plane 17 in FIG. 1.
Figure 1:
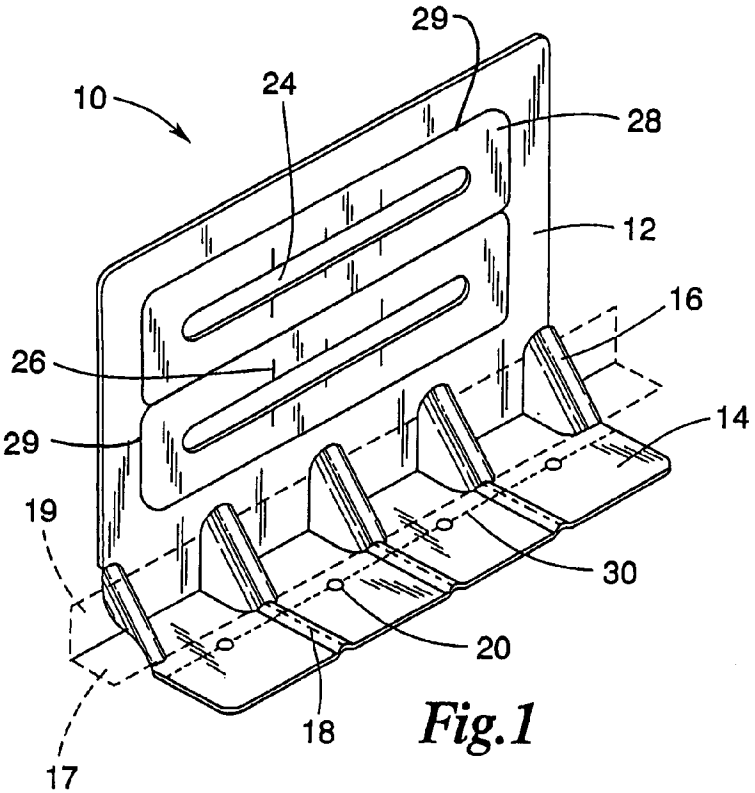
FIG. 1 is a perspective view of a first preferred embodiment of the bracket of the present invention.

FIG. 1 illustrates generally at 10 a preferred embodiment of the bracket of the present invention. Bracket 10 is preferably comprised of a stiff, durable, and thin material such as galvanized sheet steel. Preferably, the bracket 10 of the present invention is comprised of 14-gauge sheet steel having a thickness of about 0.07 inches. Depending on the need of the given construction environment, it should be appreciated that the thickness of the bracket 10 may be of essentially any commercially available sheet steel regardless of gauge or thickness. As best seen in FIG. 1, the bracket 10 includes a substantially planar first connector plate 14 and a substantially planar second connector plate 12. As seen in FIG. 1, the first connector plate 14 and the second connector plate 12 are integrally joined so as to form a right angled juncture along corresponding edges of the first and second connector plates 14, 12, respectively.

According to an important aspect of the present invention, and as seen in FIG. 1, a plurality of substantially triangular stiffener channels 16 are disposed at the intersection of the first and second connector plates 41, 12, respectively. Preferably, each of the triangular stiffener channels 16 has a substantially U-shaped cross-section in a plane (designated as 17 in FIG. 1) parallel with the first connector plate 14. See FIG. 1A. Additionally, each of the triangular stiffener channels 16 are also substantially U-shaped in cross-section in a plane (designated as 19 in FIG. 1) parallel with the second connector plate 12. See FIG. 1B. Advantageously, the triangular stiffener channels are provided to increase the rigidity and stiffener of the bracket 10.

Additionally, and as seen in FIG. 1, a number of linear stiffener ridges or channels 18 are provided (preferably in the first connector plate 14). More preferably, the linear stiffener channels 18 are disposed perpendicularly with the second connector plate 12 and extend from an end of a corresponding triangular stiffener channel 16. Preferably, the triangular stiffener channel 16 with corresponding linear stiffener channels 18, are spaced evenly across a length of the first connector plate 14.

Figure 2:
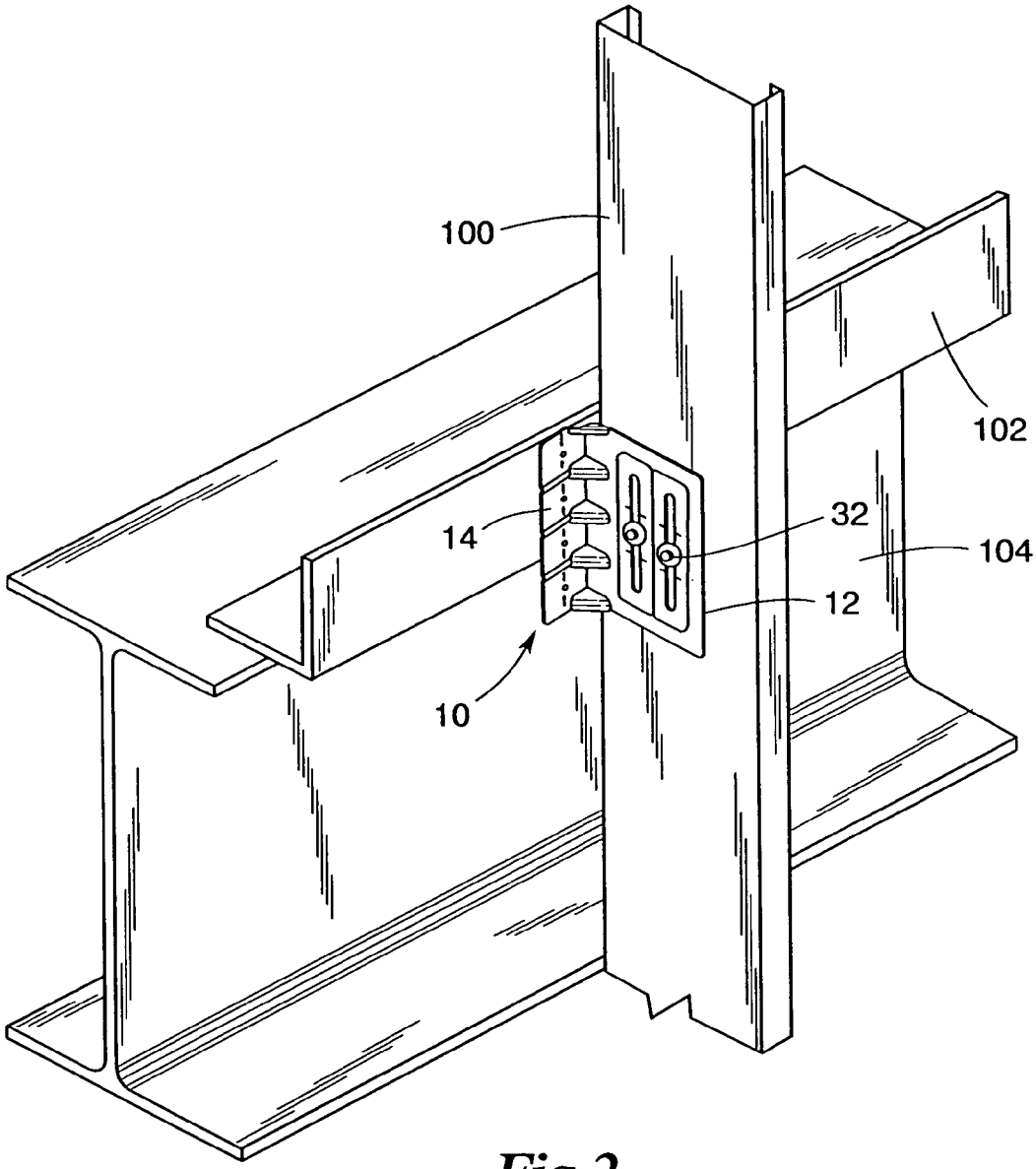
FIG. 2 is a perspective view of the bracket of FIG. 1 installed between a non-load bearing vertical stud and a horizontal structural I-beam so as to permit relative vertical movement between the two structures.

As can be seen in FIGS. 1 and 2, the second connector plate 12 is provided with one or more elongated slots 24 adapted to receive a fastener such as a shoulder screw. Preferably, all of the elongated slots 24 are substantially parallel with each other. In order to add additional rigidity to the bracket 10, each of the elongated slots 24 may be disposed within a slot stiffener region 28. Stiffener 28 is preferably made by punching a channel 29 around the region of each slot 24. More preferably, the channel 29 comprises $1/16^{th}$ inch round punched stiffener region. In order to aid an installer, measurement indicia 26 may also be provided along the length of each slot 24.

Additionally, and as shown in FIG. 1, a plurality of substantially dimples 20 may be provided to aid an installer with placement of fasteners to be inserted through the first connector panel 14. Additionally, and again in an effort to assure the accurate placement of the fasteners through the first connector plate, a score mark 30 may be provided through the dimples 20.

With reference to FIG. 2, the bracket 10 of the present invention is shown in a portion of an assembled building structure. The first connector plate 14 is shown being attached to a length of angled flange 102 which is attached to a load bearing structural I-beam 104. The first connector plate 14 may be attached to the load-bearing structural components in any suitable manner known in the art.

Preferably, a shoulder screw 32 is provided to attach the second connector plate 12 to a non-load-bearing stud 100. Preferably, the shoulder screws 32 provide substantially smooth slidable vertical movement relative to the second connector plate 12 and the non-load-bearing stud 100. Advantageously, when the structural framing (i.e., the structural I-beam 104) is subject to loading and deflected downwardly, the bracket of the present invention allows for vertical movement of the building structure without transferring compressive loads to the non-load bearing stud 100 or associated curtain wall. Accordingly, the exterior curtain wall stud may be attached to the supporting structure 104 while resisting horizontal forces and stresses caused by wind and other seismic loading. As a result, horizontal forces are resisted while the bracket 10 simultaneously provides for the vertical deflection of the primary building structure.

Figure 3:
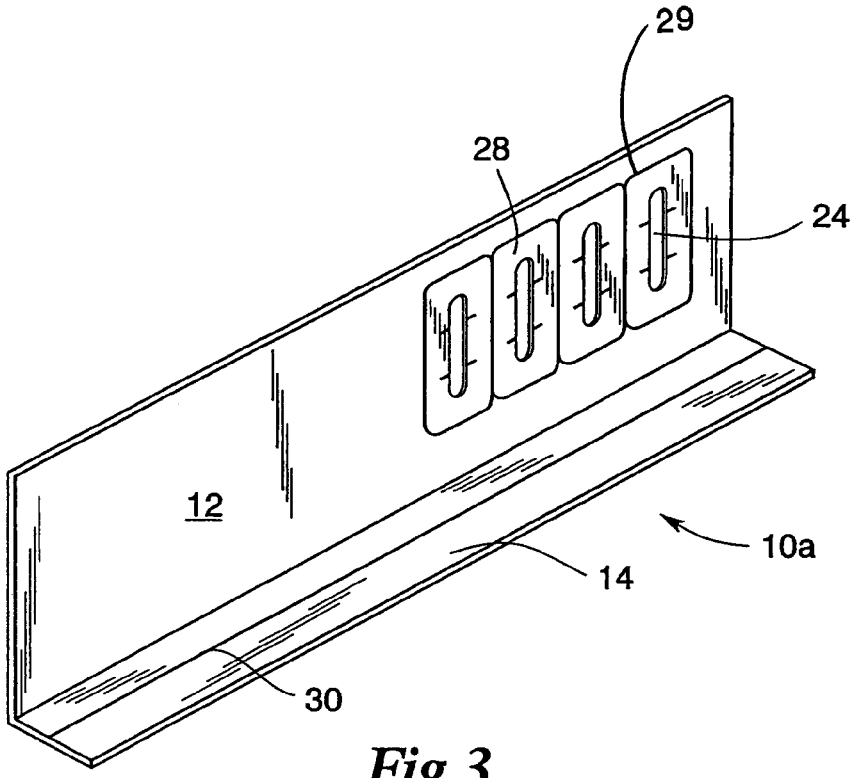
FIG. 3 is a perspective view of a second preferred embodiment of the bracket of the present invention.

With reference to FIG. 3, an alternate embodiment 10*a* of the bracket is shown having elongated slots 24 that are orientated perpendicularly with the juncture of first and second connector plates 14, 12, respectively. Depending on the configurations of the given components to be connected, the bracket 10*a* may be used to promote vertical deflection as described above.

Figure 4:
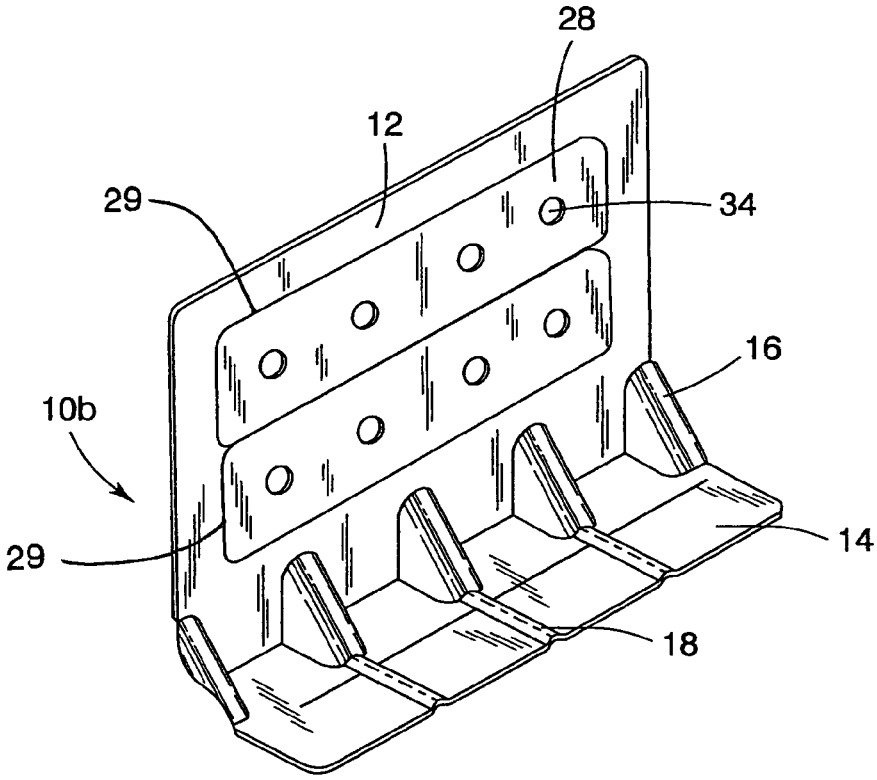
FIG. 4 is a perspective view of a third preferred embodiment of the bracket of the present invention.

As shown in FIG. 4, yet an additional embodiment of the present invention 10*b*, is depicted wherein one or more rows of holes 34 may be provided in place of the slots 24 of prior described embodiments. Preferably the holes 34 are surrounded by a stiffener region 28, much like the stiffener region 28 of the slotted embodiments of the invention. The embodiment of FIG. 10*b* is advantageous in those situations where little or no vertical deflection is desired or likely to occur between the building components being connected with the bracket 10*b*.

Figure 5:
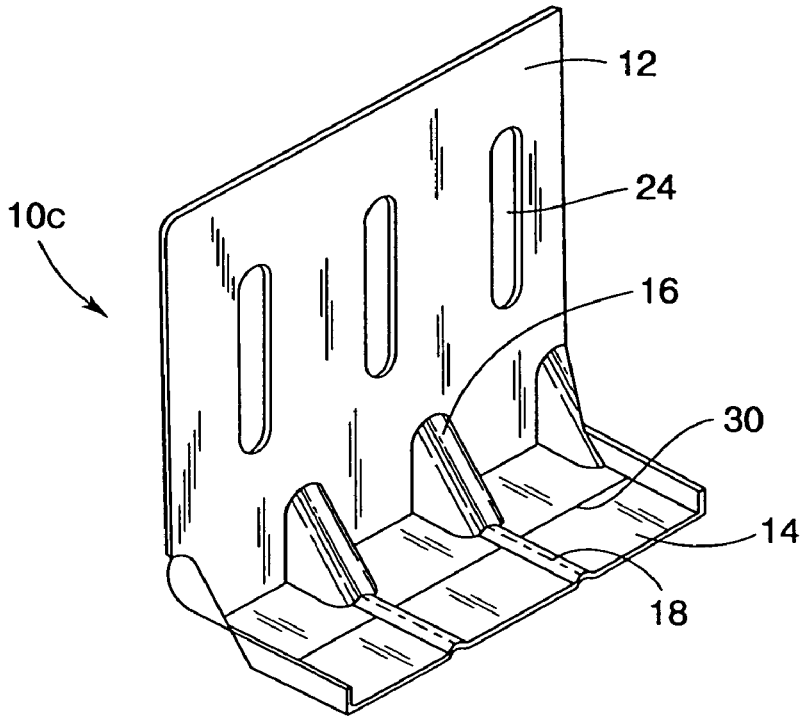
FIG. 5 is a perspective view of a fourth preferred embodiment of the bracket of the present invention.

With reference to FIG. 5, yet an additional embodiment of the bracket 10*c* is shown with an alternate arrangement of slots 24. Similar to the embodiment shown in FIG. 3, the embodiment shown in FIG. 5 is advantageous when the bracket 10*c* is linking building components where freedom of movement is desired in a direction perpendicular with the right angle juncture of the bracket 10*c*.

Figure 6:
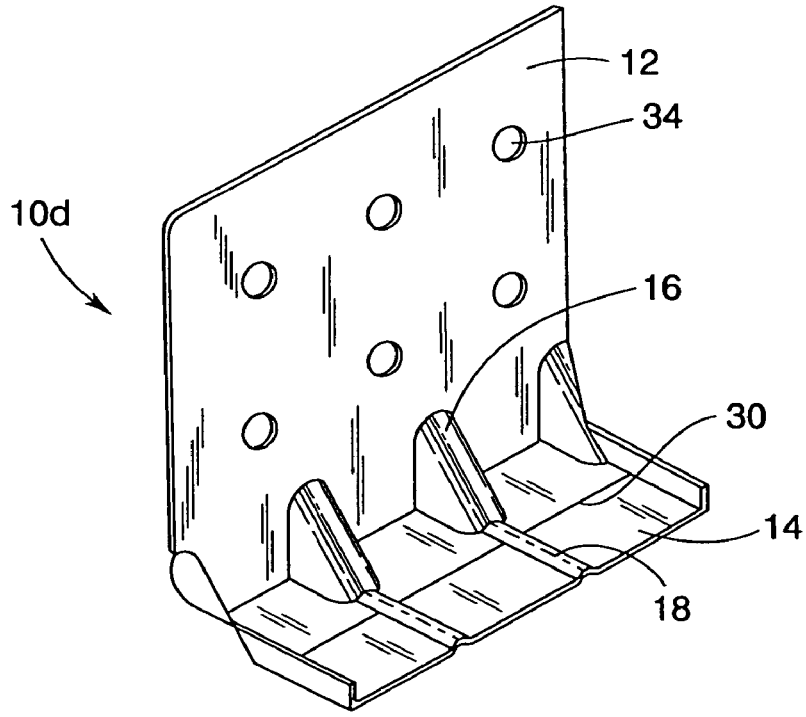
FIG. 6 is a perspective view of a fifth preferred embodiment of the bracket of the present invention.

An additional preferred embodiment of the bracket of the present invention is indicated generally by the reference numeral 10*d* in FIG. 6. This embodiment is similar to that shown in FIG. 5 except that rows of holes 34 are provided instead of a plurality of slots 24. Preferably, all alternative embodiments include the triangular stiffener channels 16 and a number of linear stiffener channels 18 to provide additional structural integrity.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiments were chosen and described in order to best illustrate the principles of the invention and their practical application to thereby enable one of ordinary skill in the art to best utilize the invention in various embodiments and with various modifications as are suited to the particular use contemplated. It is intended that the scope of the invention be defined by the claims attended hereto.

What is claimed is:

1. A bracket for connecting a pair of substantially perpendicular building components so as to allow relative vertical movement between said pair of building components, said bracket comprising:

a) a first connector plate;

b) a second connector plate, said first and second connector plates being connected with each other substantially at a right angle so as to form a right angled juncture;

c) a plurality of stiffener channels disposed in said right-angled juncture;

d) a plurality of substantially linear stiffener channels disposed in said first connector plate;

e) a plurality of elongated slots extending through said second connector plate and being substantially parallel with each other, and wherein one or more of said elongated slots is disposed within a recessed slot stiffener region in said second connector plate; and f) a plurality of collinearly disposed dimples on said first connector plate, said plurality of dimples being adapted to receive a portion of a corresponding fastener therein to guide and align the placement of said corresponding fasteners.

2. The bracket of claim 1 wherein each one of said plurality of linear stiffener channels is substantially perpendicular with said second connector plate.

3. The bracket of claim 2 wherein each one of said plurality of linear stiffener channels extends from a corresponding one of said plurality of stiffener channels in said right angled juncture.

4. The bracket of claim 1 further comprising fastener placement and measurement indicia along a length of each said elongated slot.

5. The bracket of claim 4 wherein at least one of said plurality of elongated slots is substantially parallel with said right-angled juncture.

6. The bracket of claim 4 wherein at least one of said plurality of elongated slots is perpendicular to said right-angled juncture.

7. A vertical slide clip, comprising:

a first connector plate formed from a piece of metal material and having a pair of lateral ends with an upstanding flange formed thereon;

a second connector plate formed from said piece of metal material at a right angle relative to said first connector plate so as to form a right-angled juncture therewith;

a plurality of stiffener channels formed in said piece of metal and being disposed in said right angle juncture;

at least one linear stiffener ridge formed in said first connector plate and extending from at least one of said stiffener channels;

at least one elongated slot in said second connector plate; and a score mark in said first connector plate for locating fasteners therealong, said score mark extending perpendicular to said at least one linear stiffener ridge.

8. The vertical slide clip of claim 7 further comprising a plurality of fastener-receiving dimples in said first connector plate and oriented on said score mark.

9. The vertical slide clip of claim 7 further comprising at least one measurement indicia in said second connector plate and associated with at least one said elongated slot.

10. A vertical slide clip, comprising:

a first connector plate formed from a piece of metal material and having a pair of lateral ends having an upstanding flange formed thereon;

a second connector plate formed from said piece of metal material at a right angle relative to said first connector plate so as to form a right angled juncture therewith, said right angled juncture having two ends and a central portion;

three stiffener channels formed in said piece of metal and being disposed in said central portion of said right-angled juncture;

other stiffener channels disposed at each end of said right-angled juncture;

stiffener ridges formed in said first connector plate and corresponding to each of said stiffener channels disposed in said central portion of said right angled juncture and protruding therefrom perpendicularly to said second connector plate;

at least one elongated slot in said second connector plate; and a plurality of aligned score lines in said first connector plate wherein at least one of said score lines extends between each of said stiffener ridges protruding from said stiffener channels disposed in said central portion of said right angled juncture.

11. The vertical slide clip of claim 10 wherein at least one other of said score lines is located between one of said stiffener ridges disposed in said central portion of said right angled juncture and an end of said first connector plate and wherein another of said score lines is located between another of said stiffener ridges disposed in said central portion of said right angled juncture and another end of said first connector plate.

12. The vertical slide clip of claim 10 further comprising a plurality of fastener-receiving dimples in said first connector plate wherein at least one of fastener-receiving dimples is oriented on at least one of said aligned score lines.

13. A bracket for connecting a pair of building components so as to allow relative vertical movement therebetween, said bracket comprising:

a) a first connector plate;

b) a second connector plate coupled to said first connector plate;

c) at least one stiffener channel disposed in a juncture formed by said first and second connector plates;

d) at least one linear stiffener channel disposed in said first connector plate;

e) at least one elongated slot disposed within a recessed slot stiffener region in said second connector plate; and f) at least one dimple on said first connector plate, each said dimple being adapted to receive a portion of a corresponding fastener therein to guide and align the placement of said corresponding fastener.

14. The bracket of claim 13 further comprising fastener placement and measurement indicia along a length of each said elongated slot.

15. A bracket for connecting a pair of building components together, said bracket comprising:

a) a first connector plate having one or more fastener holes therethrough for non-movably coupling said first connector plate to one of the building components;

b) a second connector plate integrally connected to said first connector plate;

c) at least one stiffener disposed in a juncture formed between said first and second connector plates;

d) at least one substantially linear stiffener channel disposed in said first connector plate;

e) one or more rows of fastener-receiving holes extending through a portion of said second connector plate for non-movably fastening said second connector plate to another one of the building components, each of said one or more rows of holes being substantially parallel with any adjacent one of said one or more rows of holes; and an endless stiffener substantially encircling the portion of said second connector plate containing said one or more rows of fastener holes.

16. A vertical slide clip, comprising:

a first connector plate formed from a piece of metal material;

a second connector plate formed from said piece of metal material;

at least one stiffener channel formed in said piece of metal and being disposed in a juncture between said first and second connector plates;

at least one linear stiffener ridge extending from at least one of said stiffener channels;

at least one elongated slot in said second connector plate; and a score mark in said first connector plate for locating fasteners therealong, said score mark extending perpendicular to said at least one linear stiffener ridge.

17. A vertical slide clip, comprising:

a first connector plate formed from a piece of metal material;

a second connector plate formed from said piece of metal material;

at least one stiffener channel formed in said piece of metal material and being disposed in a juncture between said first and second connector plates;

at least one elongated slot in said second connector plate;

a score line in said first connector plate for locating fasteners therealong; and at least one fastener-receiving dimple in said first connector plate and oriented on said score line.

18. A vertical slide clip, comprising:

a first connector plate formed from a piece of metal material;

a second connector plate formed from said piece of metal material;

at least one stiffener channel formed in said piece of metal material and being disposed in a juncture between said first and second connector plates;

at least one elongated slot in said second connector plate;

a score line in said first connector plate for locating fasteners therealong; and at least one measurement indicia in said second connector plate and associated with at least one of said elongated slots.

19. A vertical slide clip, comprising:

a first connector plate formed from a piece of metal material and having a pair of lateral ends with an upstanding flange formed thereon;

a second connector plate formed from said piece of metal material at a right angle relative to said first connector plate so as to form a right-angled juncture therewith;

a plurality of stiffener channels formed in said piece of metal and being disposed in said right-angled juncture;

a plurality of elongated slots in said second connector plate; and a score line in said first connector plate for locating fasteners therealong, said first connector plate further having a plurality of fastener-receiving dimples oriented on said score line.

20. The vertical slide clip of claim 19 wherein said score line is substantially parallel to said second connector plate.

21. The vertical slide clip of claim 19 further comprising at least one measurement indicia in said second connector plate and associated with at least one of said elongated slots.

22. A slide clip comprising:

a first connector plate;

a second connector plate at a right angle to said first connector plate;

a first recessed stiffener region in said second connector plate;

a first slot in said first recessed stiffener region;

a score line in said first connector plate;

a second recessed stiffener region in said second connector plate, said second recessed stiffener region adjacent said first recessed stiffener region; and a second in said second recessed stiffener region.

23. The slide clip of claim 22 further comprising:

a third recessed stiffener region in said second connector plate, said third recessed stiffener region adjacent said second recessed stiffener region; and a third elongated slot in said third recessed stiffener region.

24. The slide clip of claim 23 further comprising:

a fourth recessed stiffener region in said second connector plate, said fourth recessed stiffener region adjacent said third recessed stiffener region; and a fourth elongated slot in said fourth recessed stiffener region.

25. The slide clip of claim 24 wherein said first, second, third, and fourth, elongated slots are substantially parallel to each other.

26. The slide clip of claim 24 wherein said first, second, third, and fourth elongated slots are substantially perpendicular to said first connector plate.

27. A vertical slide clip, comprising:

a first connector plate formed from a piece of metal material;

a second connector plate formed from said piece of metal material such that said first and second connector plates form an L-shaped clip with a juncture therebetween;

at least one stiffener channel formed in said piece of metal material and being disposed in said juncture between said first and second connector plates;

at least one elongated slot in said second connector plate, at least one said elongated slot extending along an axis that is substantially perpendicular to said juncture; and a score line in said first connector plate for locating fasteners therealong, said first connector plate further having at least one fastener-receiving dimple oriented on said score line.

28. The vertical slide clip of claim 27 wherein said score line is substantially parallel to said second connector plate.

29. The vertical slide clip of claim 27 further comprising at least one measurement indicia in said second connector plate and associated with at least one of said elongated slots.

30. A slide clip comprising:

a first connector plate;

a second connector plate at a right angle to said first connector plate;

a first elongated slot in said second connector plate;

a stiffener channel in said second connector plate and extending around said first slot;

a score line in said first connector plate;

a second elongated slot in said second connector plate; and a second stiffener channel extending around at least a portion of said second slot and cooperating with said first stiffener channel to encircle said second slot.

31. The slide clip of claim 30 further comprising:

a third slot in said second connector plate; and a third stiffener channel extending around at least a portion of said third slot and cooperating with said second stiffener channel to encircle said third slot.

32. The slide clip of claim 31 further comprising:

a fourth slot in said second connector plate; and a fourth stiffener channel cooperating with said third stiffener channel to encircle said fourth slot.

33. The slide clip of claim 32 wherein said first, second, third, and fourth, slots are substantially parallel to each other.

34. The slide clip of claim 32 wherein said first, second, third, and fourth slots are substantially perpendicular to said first connector plate.

* * * * *